US009368943B2

(12) United States Patent
Kowalski et al.

(10) Patent No.: US 9,368,943 B2
(45) Date of Patent: Jun. 14, 2016

(54) SPARK PLUG HAVING MULTI-LAYER SPARKING COMPONENT ATTACHED TO GROUND ELECTRODE

(71) Applicant: FEDERAL-MOGUL IGNITION COMPANY, Southfield, MI (US)

(72) Inventors: Kevin J. Kowalski, Perrysburg, OH (US); Frederick J. Quitmeyer, Rochester Hills, MI (US); Nathan A. Thomson, Southgate, MI (US); Curtis W. Verhoff, Canton, MI (US); Richard L. Keller, Whitehouse, OH (US)

(73) Assignee: FEDERAL-MOGUL IGNITION COMPANY, Southfield, MI (US)

( * ) Notice: Subject to any disclaimer, the term of this patent is extended or adjusted under 35 U.S.C. 154(b) by 0 days.

(21) Appl. No.: 14/201,335

(22) Filed: Mar. 7, 2014

(65) Prior Publication Data

US 2014/0265813 A1 Sep. 18, 2014

Related U.S. Application Data

(60) Provisional application No. 61/777,169, filed on Mar. 12, 2013.

(51) Int. Cl.

| | |
|---|---|
| ***H01T 13/32*** | (2006.01) |
| ***H01T 21/02*** | (2006.01) |
| *H01T 13/39* | (2006.01) |

(52) U.S. Cl.

CPC ..... *H01T 13/32* (2013.01); *H01T 21/02* (2013.01); *H01T 13/39* (2013.01)

(58) Field of Classification Search

CPC ..... H01T 13/20; H01T 13/32; H01T 13/39

See application file for complete search history.

(56) References Cited

U.S. PATENT DOCUMENTS

| | | | | |
|---|---|---|---|---|
| 5,465,022 | A * | 11/1995 | Katoh et al. | 313/144 |
| 5,556,315 | A | 9/1996 | Kagawa | |
| 6,307,307 | B1 | 10/2001 | Kanao | |
| 6,621,198 | B2 * | 9/2003 | Kanao et al. | 313/141 |
| 7,084,558 | B2 | 8/2006 | Teramura et al. | |
| 7,385,339 | B2 | 6/2008 | Lineton et al. | |

(Continued)

FOREIGN PATENT DOCUMENTS

| | | | |
|---|---|---|---|
| CN | 102611006 | A | 7/2012 |
| DE | 102005052425 | A1 | 5/2007 |

(Continued)

OTHER PUBLICATIONS

Third Party Observation for Application No. DE 10 2014 103 308.6 dated Dec. 15, 2015, 20 pages.

(Continued)

*Primary Examiner* — Mariceli Santiago

(74) *Attorney, Agent, or Firm* — Reising Ethington, P.C.

(57) ABSTRACT

A spark plug having a metal shell, an insulator, a center electrode, a ground electrode, and a multi-layer sparking component. The multi-layer sparking component is attached at a firing end of the ground electrode and includes a thin precious metal layer formed overtop a base metal layer and, according to some embodiments, overhangs the end of the ground electrode. The precious metal and base metal layers may be pre-manufactured together as a bi-metal ribbon, sheet or laminate before the multi-layer sparking component is attached to the ground electrode.

18 Claims, 3 Drawing Sheets

(56) References Cited

U.S. PATENT DOCUMENTS

| | | | | |
|---|---|---|---|---|
| 7,521,850 | B2 | 4/2009 | Lykowski | |
| 7,671,521 | B2 | 3/2010 | Lykowski | |
| 7,808,165 | B2 | 10/2010 | Kowalski | |
| 7,948,159 | B2 | 5/2011 | Lykowski | |
| 8,044,562 | B2 | 10/2011 | Musasa et al. | |
| 8,087,961 | B2 | 1/2012 | Kameda et al. | |
| 8,120,235 | B2 | 2/2012 | Nunome et al. | |
| 8,203,258 | B2 | 6/2012 | Kameda et al. | |
| 8,294,344 | B2 | 10/2012 | Torii et al. | |
| 8,344,604 | B2 * | 1/2013 | Torii et al. | 313/141 |
| 2002/0070646 | A1 * | 6/2002 | Chiu | 313/141 |
| 2006/0220511 | A1 | 10/2006 | Hanashi et al. | |
| 2009/0289539 | A1 | 11/2009 | Sakakura | |
| 2011/0198981 | A1 * | 8/2011 | Kishimoto et al. | 313/141 |
| 2012/0112619 | A1 | 5/2012 | Kasuya et al. | |
| 2012/0187820 | A1 | 7/2012 | Mitsuda et al. | |
| 2012/0252298 | A1 | 10/2012 | Hori et al. | |
| 2012/0313503 | A1 | 12/2012 | Kasuya et al. | |
| 2013/0099655 | A1 * | 4/2013 | Kataoka | 313/142 |
| 2014/0184054 | A1 | 7/2014 | Nomura | |

FOREIGN PATENT DOCUMENTS

| | | | |
|---|---|---|---|
| EP | 2012397 | A2 | 1/2009 |
| JP | 3226981 | A | 10/1991 |
| JP | 2005203110 | A | 7/2005 |
| JP | 2009200002 | A | 9/2009 |
| WO | 2013015262 | A1 | 1/2013 |

OTHER PUBLICATIONS

English Translation of the Third Party Observation for Application No. DE 10 2014 103 308.6 dated Dec. 15, 2015, 20 pages.

* cited by examiner

SPARK PLUG HAVING MULTI-LAYER SPARKING COMPONENT ATTACHED TO GROUND ELECTRODE

REFERENCE TO RELATED APPLICATIONS

This application claims the benefit of U.S. Provisional Application No. 61/777,169, filed on Mar. 12, 2013, the contents of which are hereby incorporated by reference in their entirety.

TECHNICAL FIELD

This disclosure generally relates to spark plugs and, in particular, to a multi-layer sparking component for a ground electrode.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that causes the power stroke of the engine. The high temperatures, high electrical voltages, rapid repetition of combustion reactions, and the presence of corrosive materials in the combustion gases can create a harsh environment in which the spark plug functions. This harsh environment can contribute to erosion and corrosion of the electrodes and can negatively affect the performance of the spark plug over time, potentially leading to a misfire or some other undesirable condition.

To reduce erosion and corrosion of the spark plug electrodes, various types of noble metals and their alloys—such as those made from platinum and iridium—have been used. These materials, however, can be costly. Thus, spark plug manufacturers sometimes attempt to minimize the amount of precious metals used with an electrode by using such materials only at a firing tip of the electrodes where a spark jumps across a spark gap.

SUMMARY

According to one embodiment, a spark plug has a metal shell, an insulator, a center electrode, a ground electrode, and a multi-layer sparking component. The metal shell has an axial bore, and the insulator is partly or more disposed within the shell's axial bore. The insulator also has an axial bore, and the center electrode is partly or more disposed within the insulator's axial bore. The ground electrode is attached to the metal shell. The multi-layer sparking component is attached to the ground electrode and has a precious metal layer and a base metal layer. A portion of the multi-layer sparking component overhangs a distal end surface of the ground electrode.

According to another embodiment, a spark plug has a metal shell, an insulator, a center electrode, a ground electrode, and a pre-manufactured multi-layer sparking component. The metal shell has an axial bore, and the insulator is partly or more disposed within the shell's axial bore. The insulator also has an axial bore, and the center electrode is partly or more disposed within the insulator's axial bore. The ground electrode is attached to the metal shell. The pre-manufactured multi-layer sparking component is formed from a bi-metal ribbon before the pre-manufactured multi-layer sparking component is attached to the ground electrode. The pre-manufactured multi-layer sparking component includes a precious metal layer and a base metal layer. The precious metal layer has a greatest width dimension across its sparking surface that is several times or more larger than a greatest thickness dimension of the precious metal layer. Likewise, the base metal layer has a greatest width dimension across its bottom surface that is several times or more larger than a greatest thickness dimension of the base metal layer. The greatest thickness dimension of the precious metal layer is less than or equal to the greatest thickness dimension of the base metal layer.

According to yet another embodiment, a method of manufacturing a spark plug includes several steps. One step involves providing a metal shell, an insulator, a center electrode, and a ground electrode. Another step involves providing a pre-manufactured bi-metal ribbon. The pre-manufactured bi-metal ribbon includes a precious metal layer and a base metal layer that are joined together. Yet another step involves severing the pre-manufactured bi-metal ribbon into an individual multi-layer sparking component. The precious metal and base metal layers of the multi-layer sparking component are both thin layers. And another step involves attaching the multi-layer sparking component to the ground electrode. The base metal layer is attached directly to the ground electrode, and a portion of the multi-layer sparking component overhangs the distal end surface of the ground electrode.

BRIEF DESCRIPTION OF THE DRAWINGS

Preferred exemplary embodiments of the invention will hereinafter be described in conjunction with the appended drawings, wherein like designations denote like elements, and wherein:

FIG. 2A is a side view, FIG. 2B is an end view, and FIG. 2C is a top view of the sparking component attached to the ground electrode;

FIG. 3A is a side view, FIG. 3B is an end view, and FIG. 3C is a top view of the sparking component attached to a tapered ground electrode;

FIG. 4A is a side view, FIG. 4B is an end view, and FIG. 4C is a top view of the sparking component attached to a trimmed ground electrode; FIG. 5A is a side view, FIG. 5B is an end view, and FIG. 5C is a top view of the sparking component attached to an end surface of the ground electrode.

DETAILED DESCRIPTION OF THE PREFERRED EMBODIMENTS

Figures 1A, 1B:
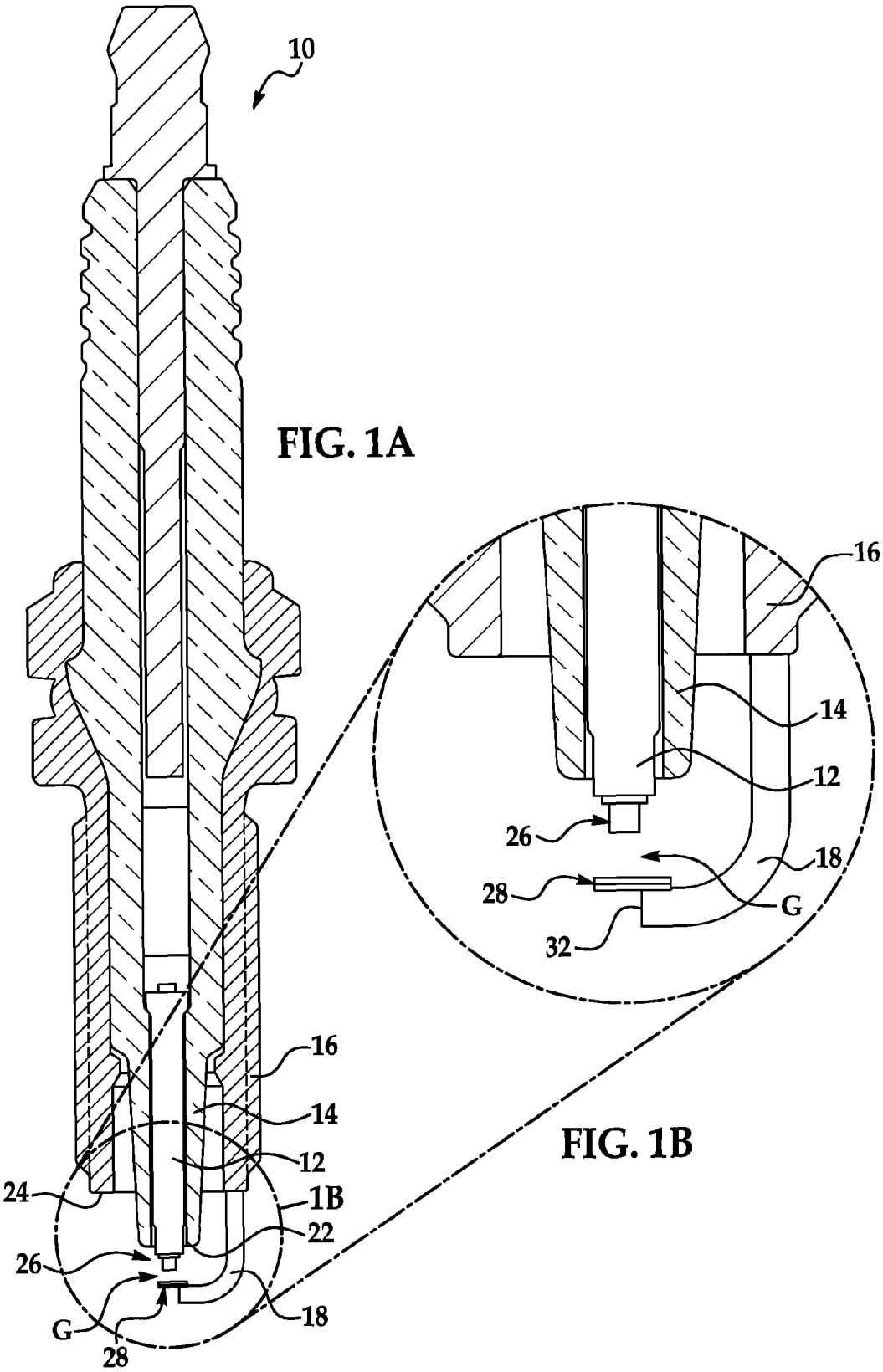
FIG. 1A is a cross-sectional view of an exemplary spark plug.
FIG. 1B is an enlarged view of the spark plug of FIG. 1A.

There is disclosed a spark plug having a multi-layer sparking component attached at a firing end of a ground electrode. The multi-layer sparking component includes a thin precious metal layer formed overtop a base metal layer and, according to some of the embodiments, overhangs the end of the ground electrode. The precious metal and base metal layers may be pre-manufactured as a bi-metal ribbon, sheet, and/or laminate before the multi-layer sparking component is attached to the ground electrode. This enables the sparking component to increase the amount of precious metal sparking area at the spark gap, yet do so with lower precious metal costs since only the thin upper layer is made from the more expensive precious metal material. Moreover, because the precious metal and base metal layers are pre-manufactured, the adhesion between these layers is improved and the base metal layer provides better weldability to the ground electrode. By having the multi-layer sparking component overhang the end of the ground electrode, there is a reduced amount of electrode mass at the firing end which can improve the thermal characteristics of the ground electrode and encourage ignitability and flame kernel growth. The multi-layer sparking component and ground electrode configuration described herein may be used in a wide array of spark plugs and other ignition devices including automotive spark plugs, industrial plugs, aviation igniters, glow plugs, or any other device that is used to ignite an air/fuel mixture in an engine. This includes, but is certainly not limited to, the exemplary embodiments that are shown in the drawings and are described below.

Referring to FIG. 1A, there is shown an exemplary automotive spark plug 10 that includes a center electrode 12, an insulator 14, a metallic shell 16, and a ground electrode 18. The center electrode 12 is disposed within an axial bore of the insulator 14 and includes a firing tip 26 that protrudes beyond a free end 22 of the insulator 14. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode 18 includes a multi-layer sparking component 28 and may be constructed according to the conventional J-gap configuration shown in the drawings or according to some other arrangement, and is attached to the free end 24 of the metallic shell 16.

The center electrode 12 and/or the ground electrode 18 may include a nickel-based external cladding layer and a copper-based internal heat conducting core. Some non-limiting examples of nickel-based materials (i.e., pure nickel or nickel alloys) that may be used with the center electrode 12 and/or the ground electrode 18 include alloys composed of nickel (Ni), chromium (Cr), iron (Fe), aluminum (Al), manganese (Mn), silicon (Si), and any suitable alloy or combination thereof, including the Ni-based alloys commonly referred to as Inconel® 600 and 601. The internal heat conducting core may be made of pure copper (Cu), Cu alloys, or some other material with suitable thermal conductivity. Of course, other materials and configurations are certainly possible, including center and/or ground electrodes that have more than one internal heat conducting core or no internal heat conducting core at all. As used herein, the term "spark plug electrode" broadly includes any spark plug center electrode, ground electrode, or a component thereof.

As shown more clearly in the enlarged view of the firing end of FIG. 1B, a spark gap G is defined between the center electrode firing tip 26 and the multi-layer sparking component 28 such that they provide sparking surfaces for the emission and reception of electrons across the spark gap. The center electrode firing tip 26 is not meant to be limited by the illustration in FIG. 1B, as that is merely one potential embodiment. For example, center electrode firing tip 26 may be in the shape of a rivet, cylinder, bar, column, wire, ball, mound, cone, flat pad, disk, ring, sleeve, etc. Center electrode firing tip 26 may be attached directly to center electrode 12, or indirectly via one or more intermediate, intervening, or stress-releasing layers. Furthermore, center electrode firing tip 26 may be located within a recess of the center electrode 12, attached to the end surface of the electrode 12, or located on the outside of the electrode 12 such as a sleeve or other annular component. To form spark gap G with center electrode firing tip 26, the multi-layer sparking component 28 is attached near an end surface or distal end surface 32 of the ground electrode 18. The multi-layer sparking component 28 may also be used in spark plugs having multiple ground electrodes, multiple spark gaps, or semi-creeping type spark gaps.

Figure 2A:
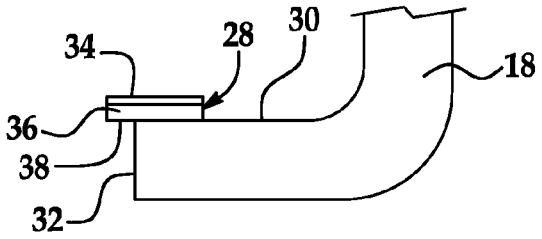
FIGS. 2A-2C are enlarged views from different perspectives of the ground electrode and the multi-layer sparking component of FIG. 1, where
Figure 2B:
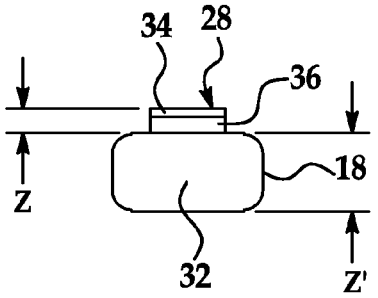
Figure 2C:
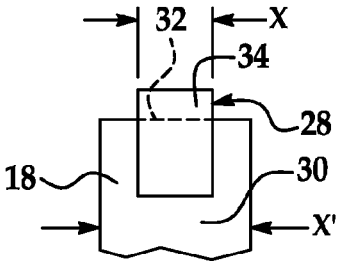

According to the embodiment shown in FIGS. 2A-C, the multi-layer sparking component 28 includes a thin precious metal layer 34 formed overtop of a thicker base metal layer 36. The thin precious metal layer 34 is made of a precious metal-based material (i.e., either a pure precious metal or a precious metal alloy where the precious metal is single largest constituent of the alloy) and provides an improved sparking surface that is more resistant to corrosion and erosion that occurs in the harsh environment of the combustion chamber than say, for example, the ground electrode material. The precious metal layer 34 is thin in the sense that its greatest width dimension across its sparking surface is several times or more larger than its greatest thickness dimension through the precious metal layer (thickness dimension is orthogonal to width dimension or sparking surface). The thin precious metal layer 34 is different than previously-known firing tip configurations with so-called fine wire constructions in which their greatest width dimension across the wire's sparking surface (i.e., the diameter) is less than their greatest thickness dimension (i.e., the axial height). Its thinness gives the precious metal layer 34 a relatively large sparking surface area available for exchanging sparks with respect to the total amount of precious metal material used, resulting in cost savings, especially when compared to the previously-known fine wire tips. Some non-limiting examples of suitable precious metal-based materials that may be used for precious metal layer 34 include platinum (Pt), iridium (Ir), rhodium (Rh), ruthenium (Ru), palladium (Pd), gold (Au), silver (Ag), various refractory and/or rare earth metals, and any suitable alloy or combination thereof. The precious metal layer 34 may be provided in the form of a thin pre-manufactured metallic ribbon or sheet or the like and, in some cases, has a thickness from about 0.05 mm to 0.4 mm, for example. In one exemplary, non-limiting embodiment, the precious metal layer 34 is made from a platinum-based ribbon (i.e., pure platinum or a platinum alloy) and has a thickness that is less than about 0.25 mm. In other exemplary, non-limited embodiments, the precious metal layer 34 is made from the platinum-based alloys Pt-10Ni or Pt-5Ir.

The base metal layer 36 acts as a backing or substrate for the multi-layer sparking component 28 in order to provide it with strength and rigidity and is preferably made of a material, like a nickel-based material, that provides improved weldability to the ground electrode 18. Some non-limiting examples of nickel-based materials that may be used for the base metal layer 36 include materials composed of nickel (Ni), chromium (Cr), iron (Fe), aluminum (Al), manganese (Mn), silicon (Si), and any suitable alloy or combination thereof, including the Ni-based alloys commonly referred to as Inconel® 600 and 601. In some embodiments, the base metal layer 36 is made from the same nickel-based alloy as the ground electrode 18; in other embodiments, the base metal layer 36 is made from a different nickel-based alloy, such as one having nickel and one or more precious metals.

Providing a thicker base metal layer 36 gives the multi-layer sparking component 28 structural integrity, provides a suitably weldable mass for attachment of the sparking component to the ground electrode 18, and minimizes the cost of the sparking component as nickel-based alloys are typically much less expensive than precious metal alloys.

Like the precious metal layer 34, the base metal layer 36 is thin in the sense that its greatest width dimension across a bottom surface 38 is several times or more larger than its greatest thickness dimension through the base metal layer (thickness dimension is orthogonal to bottom surface). The base metal layer 36 may have a thickness ranging from about 0.05 mm to 0.75 mm, for example. In one exemplary, non-limiting embodiment, the base metal layer 36 is made from a nickel-based alloy like Inconel® 601 and has a thickness that is less than about 0.75 mm, but is at least two times greater than the thickness of the precious metal layer 34. In another exemplary, non-limiting embodiment, the thickness of the precious metal layer 34 is less than or equal to the thickness of the base metal layer 36. The thickness of the precious metal layer 34 compared to the base metal layer 36 may depend on the application; for instance, automotive applications tend to call for thinner precious metal layers, while industrial applications tend to call for thicker precious metal layers. Moreover, the thickness of the precious metal layer 34 may be dictated by the desired or demanded durability of the multi-layer sparking component 28 when in use. In other words, the precious metal layer 34 can be thickened for greater durability or thinned where a high degree of durability is unnecessary.

To form the multi-layer sparking component 28, the precious metal layer 34 is joined to the base metal layer 36 according to a pre-manufacturing process prior to its attachment to the ground electrode 18. "Pre-manufacturing," "pre-manufactured," and their other forms, as used herein, broadly refer to instances where the thin precious metal layer is joined to the underlying base metal layer to form a multi-layer ribbon, sheet, and/or laminate during a manufacturing process that is separate from and before attachment of the multi-layer sparking component to the spark plug electrode. The multi-layer sparking component 28 may be formed by being cut, punched, stamped, and/or otherwise obtained from the pre-manufactured multi-layer ribbon. In some non-limiting examples, the precious metal layer 34 is joined to the base metal layer 36 via a process that includes one or more of the following processes: cladding, rolling, electrodeposition, laminating, welding, hot stamping, hot forming, etc. such that one or more intermetallic layers may be formed at the interface of the two layers. For instance, the multi-layer sparking component 28 may be made by a process that uses cladding to add the precious metal layer 34 to the base metal layer 36, rolling under high pressure to join the layers together in the form of a multi-layer ribbon, and then stamping the individual sparking components 28 from the rolled multi-layer ribbon. The cladding and rolling processes produce a cladded joint at the interface or boundary of the precious metal layer 34 and the base metal layer 36 that securely joins them together.

Pre-manufacturing processes can be advantageous for a variety of reasons over other methods where an individual piece of precious metal is simply welded to an individual intermediate component and then the combined welded assembly is attached to the ground electrode. For example, the pre-manufacturing process may take place in a controlled environment where appropriate levels of heat, pressure, etc., can be applied to the different metal layers so that a stronger inter-layer bond is created. It has been found that the pre-manufacturing process also facilitates the subsequent attachment between the sparking component 28 and ground electrode 18 since the precious metal layer 34 and base metal layer 36 can be pre-manufactured in a cleaner and more controlled manufacturing environment than is available in a typical larger spark plug manufacturing operation. This can admit cleaner surface conditions of the sparking component 28 and minimize physical variation in a single sparking component, as well as variation among different and discrete sparking components. And parts with cleaner surface conditions and greater uniformity generally ease subsequent manufacturing processes like welding. In one embodiment, the precious metal layer 34 and base metal layer 36 are pre-manufactured into a multi-layer ribbon, sheet, and/or laminate having a thickness dimension Z from about 0.1 mm to 1.15 mm, from which the individual sparking components 28 are then cut, punched, or stamped. The size and shape of the pre-manufactured sheets may vary depending on the particular application in which they are being used, and are oftentimes provided by a precious metal supplier. In some embodiments, the thickness dimension Z' of the ground electrode 18 is at least four times greater than the thickness dimension Z of the multi-layer sparking component 28. Still further, the precious metal layer 34 can be joined to the base metal layer 36 by welding processes involving electron beam welding or resistance welding, as it is not necessary for the multi-layer sparking component to be pre-manufactured. In the case of resistance welding, multiple resistance welds can be executed (e.g., two or three welds) to help produce a proper joint.

Referring back to the embodiments of FIGS. 2A-C, there is shown the multi-layer sparking component 28 hanging off, overhanging, or extending from the end surface 32 of the ground electrode 18 which, in this particular arrangement, is simply squared off at its distal end (i.e., the ground electrode is not tapered or trimmed). The multi-layer sparking component 28 has a width dimension X and the ground electrode 18 has a corresponding width dimension X' that is greater than X, however, this is not necessary. As best seen in FIG. 2C, more than half of the area and volume of the sparking component 28 is supported by the underlying ground electrode 18 (see the dashed line through the sparking component which demonstrates where the ground electrode ends). Put differently, the area or footprint or volume of the sparking component 28 that does not overhang the end 32 of the ground electrode is greater than the area or footprint or volume that does overhang the ground electrode end. This type of arrangement provides adequate support and strength for attachment of the multi-layer sparking component 28 to the ground electrode 18, yet may minimize the amount of ground electrode mass at the firing end so that desirable thermal management, ignitability, and flame kernel growth can be achieved. In addition, because only the non-overhanging portion of the sparking component 28 directly contacts the ground electrode 18, as opposed to the entire sparking component contacting the ground electrode, stresses caused by differences in rates of thermal expansion between the different metals may be reduced. The multi-layer sparking component 28 is attached to a spark-gap facing surface 30 of the ground electrode 18 so that it is slightly elevated from surface 30, as opposed to being flush with it. Here, the multi-layer sparking component 28 is not substantially set in a recess or some other indentation formed in the spark-gap facing surface 30. Other sparking component and/or ground electrode configurations are certainly possible, as will be subsequently addressed in the following embodiments.

Figure 3A:
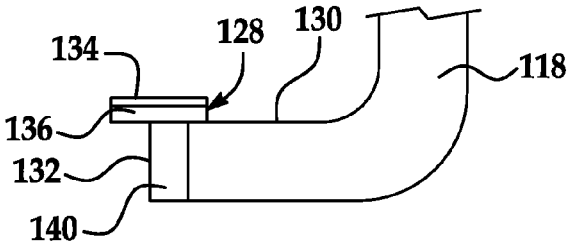
FIGS. 3A-3C are enlarged views from different perspectives of another embodiment of the ground electrode and multi-layer sparking component, where
Figure 3B:
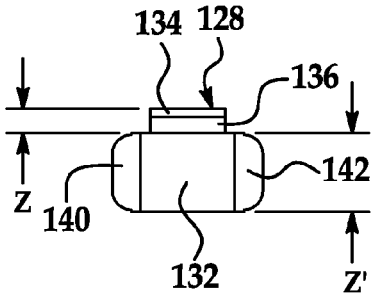
Figure 3C:
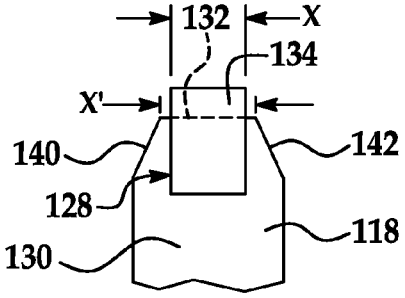

Turning now to the embodiment in FIGS. 3A-C, a multi-layer sparking component 128 is attached to a spark-gap facing surface 130 of a ground electrode 118 in much the same manner as described in the previous embodiment, except that the distal end of the ground electrode has been tapered (this is sometimes referred to as a V-trim). As before, the multi-layer sparking component 128 includes a thin precious metal layer 134 overtop a thicker base metal layer 136 and is provided in a generally rectangular shape that overhangs an end surface 132 of the ground electrode. Ground electrode 118 is tapered at its end to have a width dimension X' that is slightly greater than a corresponding width dimension X of the multi-layer sparking component 128. It is possible for the ground electrode 118 to be tapered such that width dimensions X and X' are the same or even for X' to be slightly smaller, in which case the tapered side surfaces 140, 142 would extend all the way to the sparking component 128. By tapering the distal end of the ground electrode 118, less electrode mass is located out at the firing end which can have advantageous results in terms of thermal characteristics, ignitability, and flame kernel growth, as already explained.

Figure 4A:
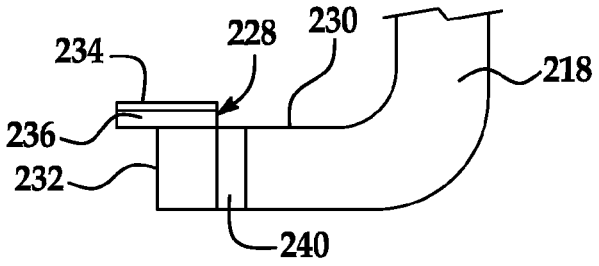
FIGS. 4A-4C are enlarged views from different perspectives of another embodiment of the ground electrode and multi-layer sparking component, where
Figure 4B:
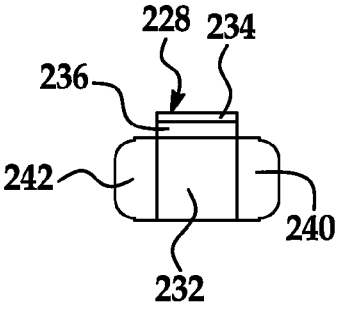
Figure 4C:
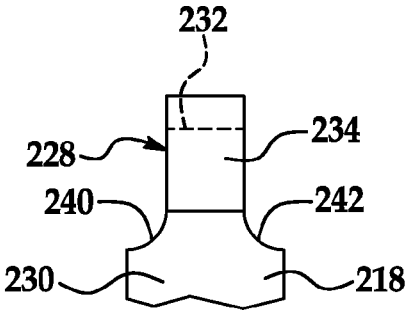

In FIGS. 4A-C, there is shown another potential embodiment of a multi-layer sparking component 228, where the arrangement is similar to the previous embodiment except that the distal end of the ground electrode 218 has been trimmed instead of tapered. As best shown in FIG. 4C, the trimmed side surfaces 240, 242 of the ground electrode have been formed so that they are curved and terminate into the sides of the sparking component 228 in a flush manner. The multi-layer sparking component is again attached to a spark gap facing surface 230 such that it rests on top of that surface, and includes thin precious metal layer 234 overtop of thicker base metal layer 236. The dashed line through the multi-layer sparking component shows where the ground electrode ends; that is, the ground electrode end or distal end surface 232. Skilled artisans will appreciate that the configuration shown in FIGS. 4A-C has a significant amount of precious metal sparking surface area at the firing end, yet has a minimal amount of electrode mass. The reasons why this may be advantageous are discussed above.

Figure 5A:
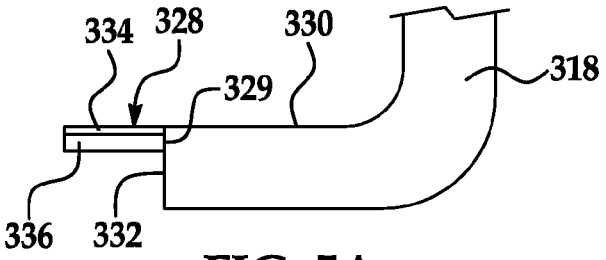
FIGS. 5A-5C are enlarged views from different perspectives of another embodiment of the ground electrode and multi-layer sparking component, where
Figure 5B:
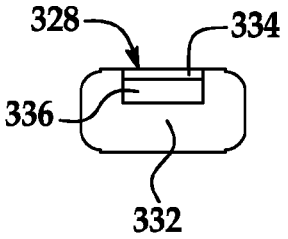
Figure 5C:
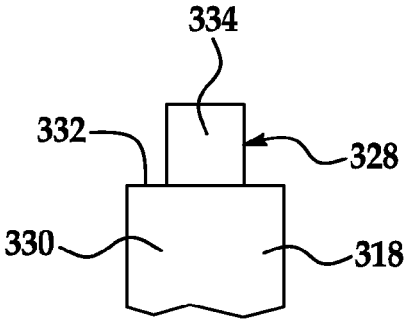

FIGS. 5A-C show another potential embodiment of a multi-layer sparking component 328 having a precious metal layer 334 formed overtop a base metal layer 336. In this particular arrangement, the sparking component 328 is attached to an end surface or distal end surface 332 of the ground electrode 318, as opposed to being attached to a spark-gap facing surface 330 like the previous embodiments. The multi-layer sparking component 328 still extends beyond and overhangs the end surface 332 in this embodiment. The end surface 332 to which the multi-layer sparking component 328 is attached, may be flat or it may have some sort of pocket or recess for better accommodating the sparking component. Because the base metal layer 336 is generally thicker than the corresponding precious metal layer 334, there would likely be more base metal material at the edge of the sparking component to contribute to the weld that joins the sparking component to the ground electrode. It is possible for the weld joint that secures the multi-layer sparking component 328 to the end surface 332 to include electrode material and material from the base metal layer 336 only, or to include electrode material and material from both layer 336 and precious metal layer 334.

Of course, the preceding embodiments are just some of the examples of suitable multi-layer sparking component designs and the present invention is not intended to be limited thereto. For example, the various multi-layer sparking components do not have to be rectangular in shape, as they could be square, circular, oval, polygonal, or curvilinear, to cite a few possibilities. Moreover, the amount or degree to which the various multi-layer sparking components overhang the end of the ground electrode could vary and, in some instances, could be more cantilevered than that illustrated in the drawings or could not overhang the distal end of the ground electrode at all. Another possible variation involves the number of layers in the multi-layer sparking component. The sparking component may include three or more individual layers pre-manufactured into a multi-layer ribbon, sheet and/or laminate—for example, a base metal layer (Inconel 601), a first precious metal layer (Pt-30Ni) and a second precious metal layer (Pt-10Ni). This could include adhesive or other intermediary layers in between precious metal and base metal layers. It is also possible for the various multi-layer sparking components to be attached to a center electrode as opposed to being limited to a ground electrode.

In manufacturing, a spark plug having the above-described multi-layer sparking component could be produced according to a number of processes, including the following. First, the multi-layer sparking component could be pre-manufactured into a multi-layer ribbon or sheet, as described above. From this pre-manufactured ribbon or sheet, the multi-layer sparking component could be cut out, punched out and/or stamped out so that an individual sparking component is formed that retains the inter-layer adhesion properties of the predecessor ribbon or sheet. The individual multi-layer sparking component could then be resistance welded to a spark gap facing surface or an end surface of the ground electrode, as also described above, in order to produce a resistance welding weldment between the base metal layer and the ground electrode. The base metal material is preferably chosen to create a solid weldment with the ground electrode material (e.g., if both metals are nickel-based materials they will have more similar rates of thermal expansion, etc.) so that additional laser welding may not be necessary. Eliminating a laser welding step can be beneficial as it reduces the cost and complexity of the manufacturing process. Still, the individual multi-layer sparking component could be solely laser welded to the spark-gap facing surface or end surface of the ground electrode without resistance welding, or could be both resistance welded for an initial temporary pre-attachment and laser welded for a subsequent permanent attachment. Whatever attachment technique employed, in the embodiments of FIGS. 2A-2C, 3A-3C, and 4A-4C, a surface-to-surface attachment results between the bottom surface 38 (FIG. 2A) of the base metal layer and the spark-gap facing surface of the ground electrode; similarly in FIGS. 5A-5C a surface-to-surface attachment results but this time between a side surface 329 (FIG. 5A) of the multi-layer sparking component 328 (which also includes side surfaces of precious metal layer 334 and base metal layer 336) and the side surface 332. Once the sparking component is attached to the ground electrode, the electrode can then be bent into place and positioned with respect to the center electrode so that the desired spark gap is formed. Any other known and suitable spark plug manufacturing steps may also be used in addition to or in lieu of those outlined above.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug, comprising:

a metal shell having an axial bore;

an insulator at least partially disposed in the metal shell axial bore and having an axial bore;

a center electrode at least partially disposed in the insulator axial bore;

a ground electrode attached to the metal shell and having a spark-gap facing surface and a distal end surface; and a multi-layer sparking component attached to the spark-gap facing surface of the ground electrode with a resistance welded weldment and having a precious metal layer that is precious metal based and a base metal layer that is non-precious metal based, wherein a greatest thickness dimension of the precious metal layer ranges between approximately 0.05 mm and 0.25 mm, inclusive, the multi-layer sparking component includes an intermetallic layer formed between the precious metal layer and the base metal layer before the multi-layer sparking component is resistance welded to the spark-gap facing surface of the ground electrode, and a portion of the multi-layer sparking component overhangs the distal end surface of the ground electrode.

2. The spark plug of claim 1, wherein the precious metal layer is a thin layer with the greatest width dimension across a sparking surface that is at least several times larger than a greatest thickness dimension through the precious metal layer.

3. The spark plug of claim 1, wherein the precious metal layer has a greatest thickness dimension that is less than the greatest thickness dimension of the base metal layer.

4. The spark plug of claim 1, wherein the multi-layer sparking component is a pre-manufactured bi-metal ribbon with the precious metal layer and base metal layer joined together prior to attachment of the multi-layer sparking component to the ground electrode.

5. The spark plug of claim 4, wherein the pre-manufactured bi-metal ribbon has a cladded joint between the precious metal layer and the base metal layer.

6. The spark plug of claim 1, wherein a greatest width dimension and a greatest length dimension of the precious metal layer is the same as a greatest width dimension and a greatest length dimension of the base metal layer.

7. The spark plug of claim 1, wherein the base metal layer is attached directly to the ground electrode via a weldment located between the base metal layer and the ground electrode.

8. The spark plug of claim 7, wherein the base metal layer and the ground electrode are made from nickel or a nickel-based alloy, and the base metal layer is attached directly to the ground electrode via a resistance welded weldment located between the base metal layer and the ground electrode.

9. The spark plug of claim 7, wherein the base metal layer is attached directly to the ground electrode via a surface-to-surface attachment between a bottom surface of the base metal layer and the spark-gap facing surface of the ground electrode.

10. The spark plug of claim 9, wherein a volume of the portion of the multi-layer sparking component that overhangs the distal end surface is less than a volume of the multi-layer sparking component that does not overhang the distal end surface and is supported by the ground electrode.

11. The spark plug of claim 1, wherein the precious metal layer is made from platinum or a platinum-based alloy.

12. A spark plug, comprising:

a metal shell having an axial bore;

an insulator at least partially disposed in the metal shell axial bore and having an axial bore;

a center electrode at least partially disposed in the insulator axial bore;

a ground electrode attached to the metal shell; and a pre-manufactured multi-layer sparking component formed from a bi-metal ribbon prior to attachment of the pre-manufactured multi-layer sparking component to the ground electrode, the pre-manufactured multi-layer sparking component comprising:

a precious metal layer that is platinum-based and has a greatest width dimension across a sparking surface of the precious metal layer that is at least several times larger than a greatest thickness dimension through the precious metal layer, wherein the greatest thickness dimension of the precious metal layer ranges between approximately 0.05 mm and 0.25 mm, inclusive;

a base metal layer that is nickel-based and has a greatest width dimension across a bottom surface of the base metal layer that is at least several times larger than a greatest thickness dimension through the base metal layer, wherein the greatest thickness dimension of the precious metal layer is less than or equal to the greatest thickness dimension of the base metal layer; and an intermetallic layer having platinum and nickel that is formed at the interface between the precious metal layer and the base metal layer.

13. The spark plug of claim 12, wherein the greatest thickness dimension of the base metal layer ranges between approximately 0.05 mm and 0.75 mm, inclusive.

14. The spark plug of claim 12, wherein a joint between the precious metal layer and base metal layer of the pre-manufactured multi-layer sparking component is a cladded joint formed at the time the bi-metal ribbon was formed.

15. A method of manufacturing a spark plug, the method comprising:

providing a metal shell, an insulator, a center electrode, and a ground electrode with a distal end surface and a spark-gap facing surface;

providing a pre-manufactured bi-metal ribbon including a precious metal layer that is precious metal based and a base metal layer that is non-precious metal based, wherein a greatest thickness dimension of the precious metal layer ranges between approximately 0.05 mm and 0.25 mm, inclusive, and the precious metal layer and the base metal layer are joined together so that an intermetallic layer is formed between the precious metal layer and the base metal layer;

severing the pre-manufactured bi-metal ribbon into an individual multi-layer sparking component, the precious metal layer and the base metal layer of the multi-layer sparking component are both thin layers; and resistance welding the multi-layer sparking component to the spark-gap facing surface of the ground electrode with the base metal layer attached directly to the ground electrode, a portion of the multi-layer sparking component overhanging the distal end surface of the ground electrode.

16. The method of claim 15, wherein the multi-layer sparking component is attached to the ground electrode via a surface-to-surface attachment between a bottom surface of the base metal layer and the spark-gap facing surface of the ground electrode.

17. A spark plug, comprising:

a metal shell having an axial bore;

an insulator at least partially disposed in the metal shell axial bore and having an axial bore;

a center electrode at least partially disposed in the insulator axial bore;

a ground electrode attached to the metal shell and having a distal end surface, a spark-gap facing surface, and a plurality of trimmed side surfaces; and a multi-layer sparking component attached to the spark-gap facing surface of the ground electrode and having a precious metal layer and a base metal layer, wherein a portion of the multi-layer sparking component overhangs the distal end surface of the ground electrode and the trimmed side surfaces of the ground electrode terminate into one or more sides of the multi-layer sparking component in a flush manner.

18. A spark plug, comprising:

a metal shell having an axial bore;

an insulator at least partially disposed in the metal shell axial bore and having an axial bore;

a center electrode at least partially disposed in the insulator axial bore;

a ground electrode attached to the metal shell and having a distal end surface and a spark-gap facing surface; and a multi-layer sparking component having a precious metal layer and a base metal layer, wherein the multi-layer sparking component is attached to the distal end surface of the ground electrode so that the precious metal layer of the multi-layer sparking component is generally aligned with the spark-gap facing surface of the ground electrode and a portion of the base metal layer of the multi-layer sparking component extends beyond the distal end surface of the ground electrode.

* * * * *